US005927498A

United States Patent [19]

Saam

[11] Patent Number: 5,927,498

[45] Date of Patent: Jul. 27, 1999

[54] PACKAGING OF STAND-UP, FLEXIBLE POUCHES

[75] Inventor: Bernhard Saam, Bern, Switzerland

[73] Assignee: Profile Packaging, Inc., Sarasota, Fla.

[21] Appl. No.: 08/970,334

[22] Filed: Nov. 14, 1997

Related U.S. Application Data

[60] Provisional application No. 60/030,975, Nov. 15, 1996.

[51] Int. Cl.[6] ..... B65D 17/28

[52] U.S. Cl. ..... 206/499; 206/822; 229/240

[58] Field of Search ..... 206/436, 499, 206/503, 526, 746, 822; 383/32, 907; 229/240, 242

[56] References Cited

U.S. PATENT DOCUMENTS

| | | | |
|---|---|---|---|
| 1,571,918 | 2/1926 | Barbieri | 206/436 |
| 1,657,942 | 1/1928 | Spaldo | 206/746 |
| 2,020,876 | 11/1935 | Clark et al. . | |
| 2,042,107 | 5/1936 | Koeble . | |
| 2,152,079 | 3/1939 | Mott | 206/746 |
| 2,315,999 | 4/1943 | Holm . | |
| 2,444,987 | 7/1948 | Giessen | 206/499 |
| 3,111,255 | 11/1963 | Skowronski . | |
| 3,139,979 | 7/1964 | Russell . | |
| 3,360,182 | 12/1967 | Gunn . | |
| 3,367,489 | 2/1968 | Schneider et al. | 206/436 |
| 3,403,836 | 10/1968 | Farquhar . | |
| 3,510,046 | 5/1970 | Reiner . | |
| 3,618,758 | 11/1971 | Shaw et al. | 206/436 |
| 3,653,495 | 4/1972 | Gray | 206/746 |
| 3,884,348 | 5/1975 | Ross | 206/746 |
| 4,582,194 | 4/1986 | Karpiloff et al. | 206/499 |
| 5,178,280 | 1/1993 | Ohlsson | 206/499 |

FOREIGN PATENT DOCUMENTS

| | | |
|---|---|---|
| 0 266 321 A2 | 10/1987 | European Pat. Off. . |
| 0 442 179 A1 | 8/1991 | European Pat. Off. . |
| 562.868 | 11/1923 | France . |
| 1.152.875 | 2/1958 | France . |
| 1.467.157 | 5/1967 | France . |
| 91 10 184 U1 | 10/1991 | Germany . |
| 93 00 738 U1 | 7/1993 | Germany . |
| 1098789 | 2/1968 | United Kingdom . |

*Primary Examiner*—Jim Foster

*Attorney, Agent, or Firm*—Gifford, Krass, Groh, Sprinkle, Anderson & Citkowski, P.C..

[57] ABSTRACT

A package for a plurality of stand-up pouches in which a rectilinear container holds the pouches with closed top portions of the pouch and is arranged between adjacent base portions of the pouches in the second row to occupy a minimum space. The container can be opened by separating portions along lines of weakening to form display trays which are separate from each other or which are attached to each other in side by side or end to end relationship, all without requiring unpacking or rearranging of the pouches within the container.

5 Claims, 4 Drawing Sheets

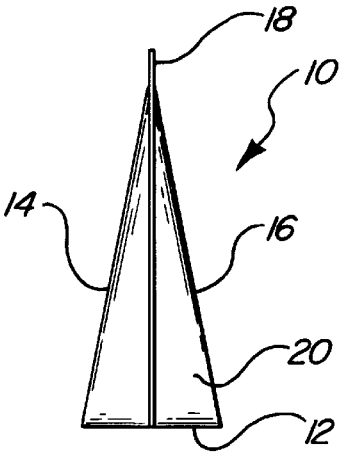
FIG-1
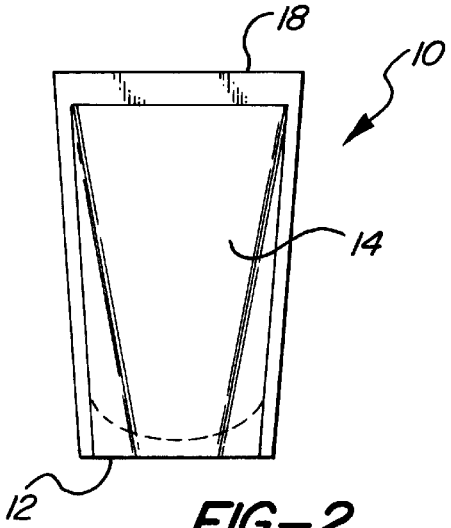
FIG-2
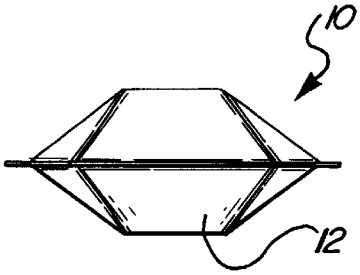
FIG-3
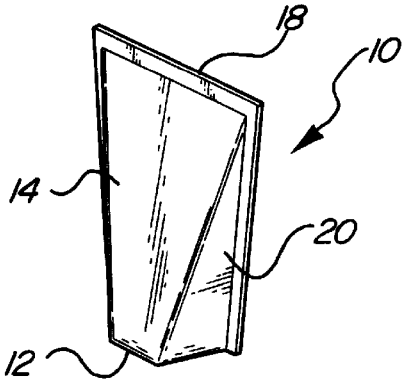
FIG-4
FIG-5
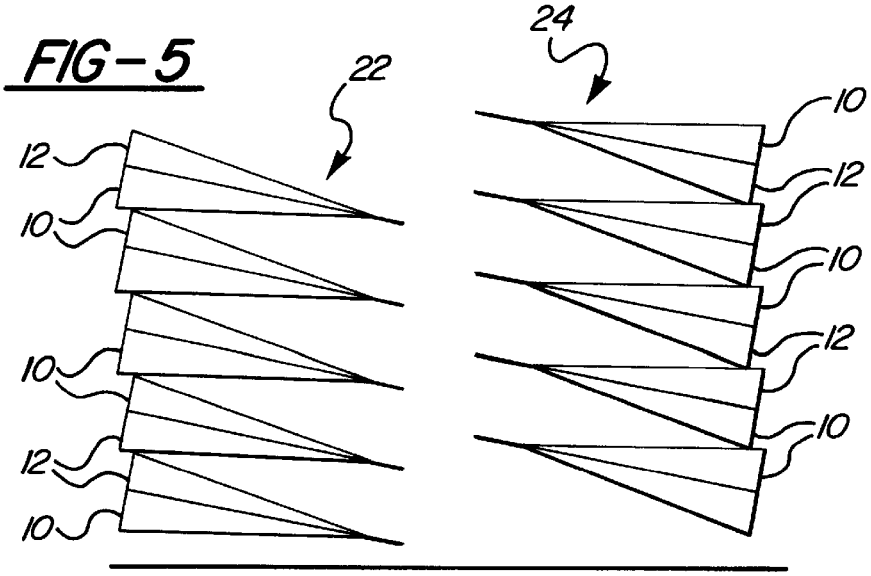

PACKAGING OF STAND-UP, FLEXIBLE POUCHES

This application claims the benefit of Provisional Application Ser. No: 60/030,975 filed Nov. 15, 1996.

This invention relates to packaging and particularly packaging of standup, flexible pouches.

Pouches are used for packaging a variety of products in liquid or in dry form but because of the configuration of a filled pouch, packaging a quantity of pouches for shipment or the display of multiple pouches has always been a problem.

A typical stand-up pouch has a generally flat bottom to support the package in its stand-up position. At the top of such pouches, the front and rear panels of the pouch are in adjacent, sealed relationship to each other. As viewed from the side, such pouches have a wide bottom and a generally triangular configuration but as viewed from the front, the bottom is narrower than the top.

The present invention contemplates arranging adjacent pouches so that the bottom of one pouch is adjacent to the top of the adjacent pouch. The pouches are so arranged that the volume occupied by the number of such pouches is reduced to a minimum. With a plurality of pouches arranged in this manner, the invention contemplates packaging the plurality of pouches in a paper board or corrugated paper package or carton having a rectilinear configuration so that the bottoms of the pouches are adjacent to opposed side panels of the rectilinear package containing the pouches.

The invention also contemplates separating the package or carton along a line of weakening to divide the package into two separate display trays so that upon dividing the package two trays are formed, each with one half of the pouches with the side wall of the original package forming the bottom of a first tray, and with the other side wall adjacent to the bottom of the other half of the pouches forming the bottom of the second tray. The arrangement makes it possible not only to group the pouches into a minimum volume container but also to utilize the container for a display tray of the pouches at the retail sales outlet. Also, if desired, the two display trays can be left partially connected to each other to facilitate alignment.

DESCRIPTION OF THE DRAWINGS

FIG. 1 is a side elevation of a pouch of a type related to the present invention;

FIG. 2 is a front elevation of the pouch seen in FIG. 1;

FIG. 3 is a bottom view of the pouch seen in the prior figures;

FIG. 4 is a perspective view of a pouch seen in the prior figures;

FIG. 5 is a diagrammatic view of a plurality of pouches of the type seen in the prior figures, arranged in groups just prior to inter-leafing the packages into a compact pack;

DETAILED DESCRIPTION

Figure 6:
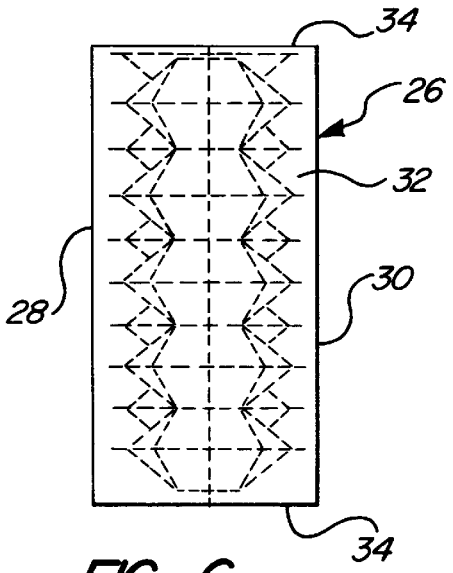
FIG. 6 is an elevation of one side of a package containing a plurality of pouches.

Referring to the drawings and particularly to FIG's 1 through 4, a typical stand-up pouch is designated at 10. Such pouches 10 are made of flexible plastic material and in their empty condition are flat. In the filled condition the pouches have a flat bottom 12, generally rectilinear front and rear panels 14 and 16, respectively, which extend from the bottom 12 into adjacent contacting and sealed relationship with each other at the top 18 of the pouch. The bottom 12 of the pouch is in the form of a hexagon. The opposed side walls or gussets of the pouch 10 are designated at 20 and have a generally triangular configuration with the base being at the bottom. When viewed from the front or back, as seen in FIG. 2, the bottom 12 is slightly narrower than the top 18.

Such pouches 10 can be produced on a horizontal flat bag machine which, by way of example, can be of a type manufactured by Laudenberg Machinery, Inc., and generally designated as Models FBM. Such machines can be used for manufacturing a large variety of relatively flat pouches.

Although pouches 10 have many advantages for packaging both liquids and dry products, they are difficult to package for shipment or to display in quantities.

Figure 7:
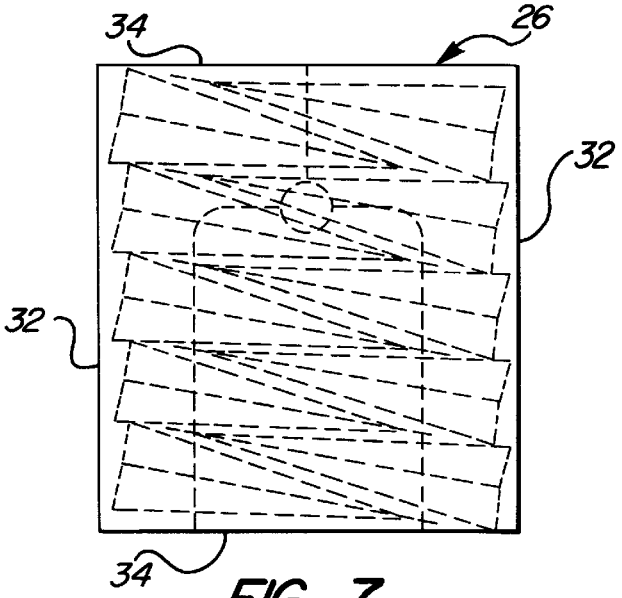
FIG. 7 is an elevation demonstrating inter-leaf pouches within a package.
Figure 8:
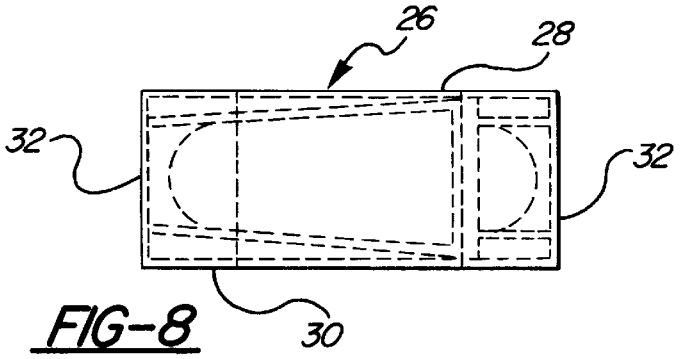
FIG. 8 is a plan view of the pouches in a package.

In accordance with the present invention, such pouches 10 are arranged in two tiers 22 and 24, as illustrated in FIG. 5. The packages 10 in each tier 22, 24 are grouped so that their bottoms 12 face in the same direction and opposite to the direction of the bottoms 12 in the other tier. The tiers can be arranged so that with the top ends 18 facing each other, the two tiers can be brought together to inter-leaf the pouches 10 with each other, as seen in FIG. 7. Thereafter, the pouches 10 can be encased in a rectilinear container 26 made of paper board or corrugated paper. In this condition the pouches 10 occupy a minimum volume which is encased by the package or rectilinear container 26.

Such a container 26 can be regarded as having a top wall 28 and a bottom wall 30 spaced in parallel relationship to each other, a pair of parallel, opposed side walls 32 and a pair of parallel opposed end walls 34.

Figure 9:
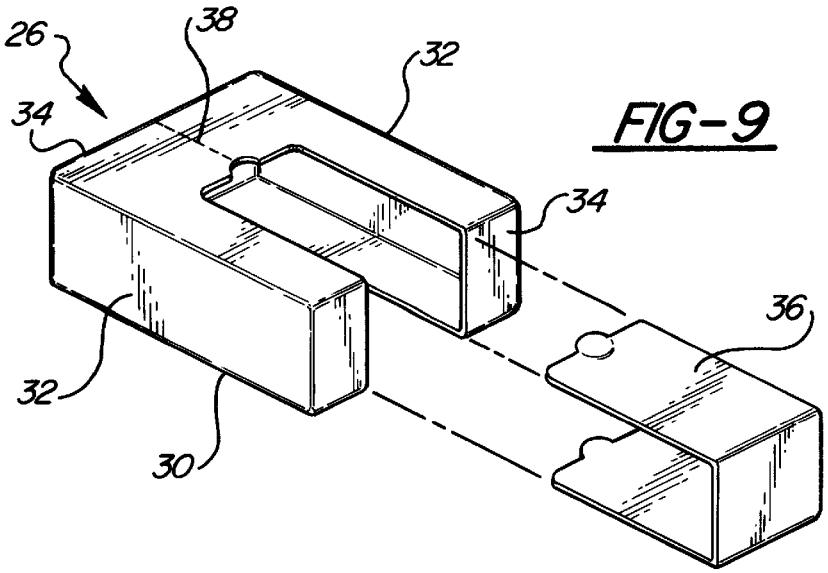
FIG. 9 is an exploded perspective view of the packaging container without pouches illustrating a manner of separating the packages.

As viewed in FIG. 9, the container or package 26 can be formed with perforations or other lines of weakening by which a pull portion or tab 36 can be separated and removed. The portion 36 includes portions of the top wall 28, bottom wall 30 and one of the end walls 34. The remaining portion of the package 26 can be separated along a central line of weakening 38 and divided into two trays 40 as seen in FIG. 10 or 11 with the removed tab 36 serving to form a shallow portion at the one end of the trays 40.

Figure 10:
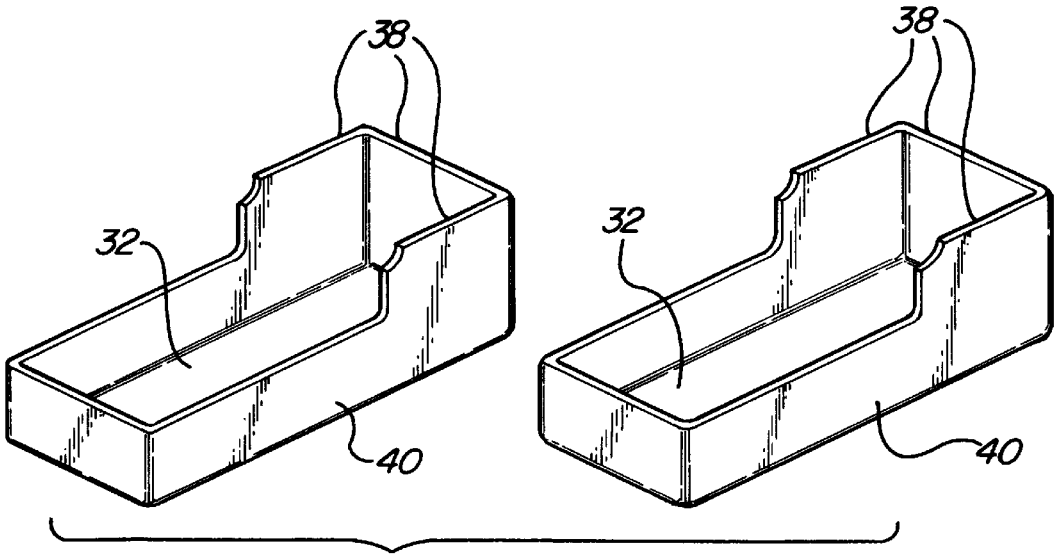
FIG. 10 is a view of empty display trays resulting from a single package but without pouches.
Figure 11:
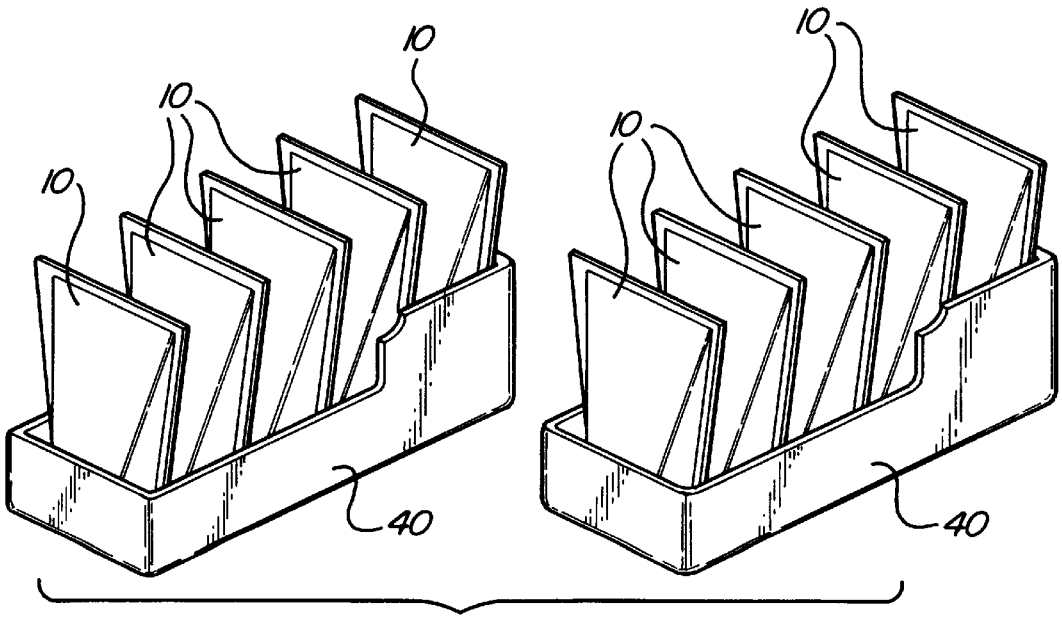
FIG. 11 is similar to FIG. 10 but illustrating the trays with the pouches in a displayed position.

For clarity, FIGS. 9 and 10 illustrate the package 26 without pouches 10. However, when the package 26 is loaded with pouches 10, as illustrated in FIG. 7, removal of the pull tab 36 and separation along the line 38 results in exposing the pouches 10. Thereafter, the two trays 40 can be moved in opposite directions from each other together with the pouches 10 so that the opposite side walls 32 form the bottoms of the trays 40. The two tiers of pouches 10 will separate and move with the respective trays 40 and will result in the pouches 10 being exposed as seen in FIG. 11 ready to place on display at the marketing outlet without requiring an additional handling.

Figure 12:
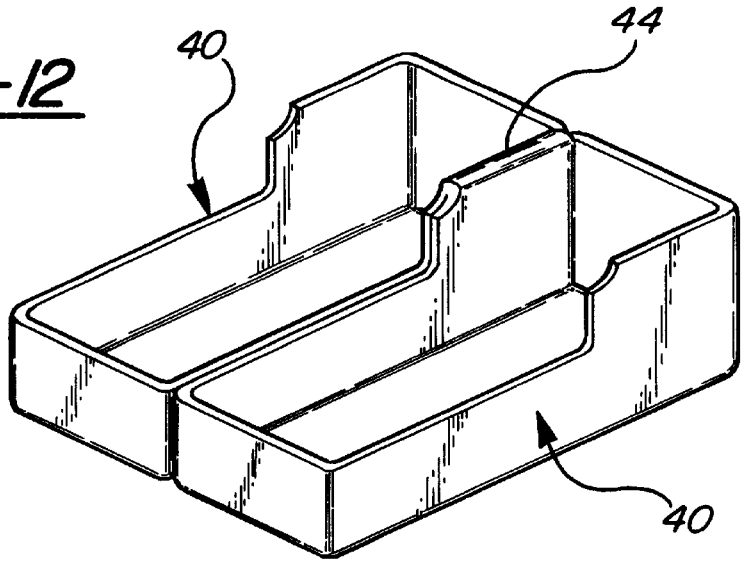
FIG. 12 is a view of empty display trays remaining attached to each other in side by side relationship.
Figure 13:
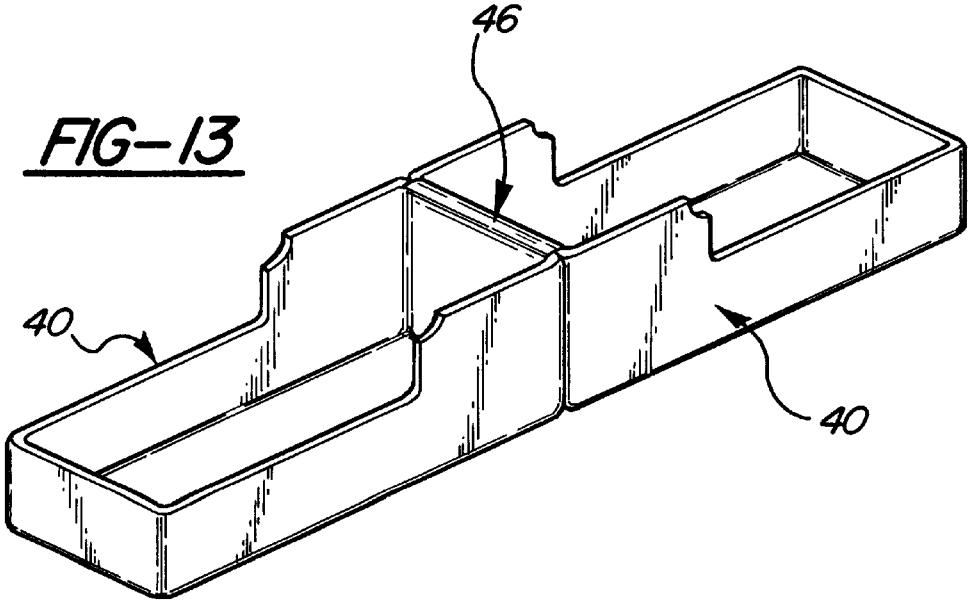
FIG. 13 is a view of empty display trays remaining attached and arranged in end to end relationship.

It will be understood that such display trays 40 can be arranged singly, in side by side or end to end relationship. By way of example, and as best seen in FIG. 12, the trays 40 may be disposed and attached in side by side relationship or as seen in FIG. 13, in end to end relationship. This is accomplished in the arrangement shown in FIG. 12 by separating the line of weakening 38, except the portion indicated at 44 between adjacent side walls of the trays 40. This serves to maintain the trays attached to each other so that alignment is maintained when the trays are disposed on a display surface. Similarly, as shown in FIG. 13, the portion of the tear strip 38 associated with the end wall of the container, and indicated at 46 in FIG. 13, may be left intact to maintain alignment of the trays 40 in end to end relationship. Also, It will be understood that other configurations of the packaging container 26 can be used to result in trays 40 and that the trays can have a variety of configurations.

The inter-leafing of the pouches 10 and loading them into a packaging container can be conducted by machinery in conventional manner. The method of packaging pouches 10 entails the arranging of pouches in two inter-leafed tiers 22 and 24 with the bottoms 12 of adjacent pouches extending in opposite directions and with the front panel of one pouch in adjacent relationship to the back panel of an adjacent pouch. Thereafter, the inter-leafed tiers can be placed in a packaging container 26 which is divisible into a pair of display trays 40 holding the pouches in position relative to the tray for displaying pouches 10 at the point of sale without requiring any handling of the pouches.

The package or a quantity of stand-up pouches has been provided in which the pouches may be arranged in two tears with the tops of pouches in one tear interleaved between the bases of the pouches in the other tear, all to maintain a maximum number of pouches within a given volume of a container. The container itself can be separated or opened to form a pair of display trays which can be completely separated or attached to each other in side by side or end to end relationship to offer the pouches to view without requiring rearrangement or handling.

I claim:

1. A package for shipping and displaying a plurality of stand up pouches, comprising:

a rectilinear container heaving opposed side panels, opposed end panels and top and bottom panels joined together to form a closed container, said container having a line of weakening having one end spaced apart from said top panel and an other end spaced apart from said bottom panel, said line of weakening extending from said one end across one of said pair of end panels to said other end, said line of weakening extending on a plane extending midway between and parallel with said pair of side panels, and said container further having a removable portion extending between said pair of ends of said line of weakening across an other end of said pair of end panels, a plurality of stand up pouches filled with material and disposed to said container, said pouches having a general wedge shape with a supporting base and front and back walls extending from opposite sides of said base and abutting each other to form, a flat top portion, said pouches being arranged in said container in two tiers with the bases of said pouches in one tier being adjacent one of said side panels of said container and said flat top portion of said pouches in said one tier being adjacent the other of said side panels of said container and adjacent said bases of said pouches in the other of said tiers, said front and back walls of said plurality of pouches extending across said plane, and said container being separable into a pair of display trays with said opposed side panels of said container forming the bottoms of said display trays when said line of weakening is broken and said two tiers are unleaved such that each of said display trays holds one of said two tiers.

2. The package of claim 1 wherein a line of weakening is formed in panels of said container for separation of said container into said pair of display trays.

3. The combination of claim 2 wherein said container is separable along said line of weakening except along a portion forming a fold line in one of said top or bottom panels for folding of said trays into an attached, side by side relation.

4. The combination of claim 2 wherein said container is separated along said line of weakening except along a portion forming a fold line in one of said end panels for folding of said trays to an attached, end to end relation.

5. The combination of claim 1 wherein said front walls of said pouches in both of said tiers face in the same direction.

* * * * *

US005927498B1

(12) REEXAMINATION CERTIFICATE (4433rd)

United States Patent

Saam

(10) Number: US 5,927,498 C1

(45) Certificate Issued: Aug. 28, 2001

(54) PACKAGING OF STAND-UP, FLEXIBLE POUCHES

(75) Inventor: Bernhard Saam, Bern (CH)

(73) Assignee: Profile Packaging, Inc., Sarasota, FL (US)

Reexamination Request:
No. 90/005,658, Mar. 2, 2000

Reexamination Certificate for:

| | |
|---|---|
| Patent No.: | **5,927,498** |
| Issued: | **Jul. 27, 1999** |
| Appl. No.: | **08/970,334** |
| Filed: | **Nov. 14, 1997** |

Related U.S. Application Data

(60) Provisional application No. 60/030,975, filed on Nov. 15, 1996.

(51) Int. Cl.[7] ..... B65D 17/28

(52) U.S. Cl. ..... 206/499; 206/822; 229/240

(58) Field of Search ..... 206/436, 499, 206/503, 526, 738, 739, 745–750, 822; 229/120.01, 120.011, 240, 242; 383/32

(56) References Cited

U.S. PATENT DOCUMENTS

| | | | | |
|---|---|---|---|---|
| D. 412,114 | * | 7/1999 | Hansen | D9/416 |
| 1,571,918 | * | 2/1926 | Barbieri | 206/436 |
| 1,657,942 | * | 1/1928 | Spaldo | 206/746 |
| 2,020,876 | * | 11/1935 | Clark et al. . | |
| 2,042,107 | * | 5/1936 | Koeble . | |
| 2,152,079 | * | 3/1939 | Mott | 206/746 |
| 2,315,999 | * | 4/1943 | Holm . | |
| 2,444,987 | * | 7/1948 | Giessen | 206/499 |
| 3,111,255 | * | 11/1963 | Skowronski . | |
| 3,139,979 | * | 7/1964 | Russell . | |
| 3,360,182 | * | 12/1967 | Gunn . | |
| 3,367,489 | * | 2/1968 | Schneider et al. | 206/436 |
| 3,403,836 | * | 10/1968 | Farquhar . | |
| 3,510,046 | * | 5/1970 | Reiner . | |
| 3,618,758 | * | 11/1971 | Shaw et al. | 206/436 |
| 3,653,495 | * | 4/1972 | Gray | 206/746 |
| 3,884,348 | * | 5/1975 | Ross | 206/746 |
| 4,582,194 | * | 4/1986 | Karpiloff et al. | 206/499 |
| 5,178,280 | * | 1/1993 | Ohlsson | 206/499 |

FOREIGN PATENT DOCUMENTS

| | | | |
|---|---|---|---|
| 15182 | * | 1/1974 | (CH) . |
| 9110484.0 | * | 10/1991 | (DE) . |
| 9300738.8 | * | 7/1993 | (DE) . |
| 0266321 | * | 10/1987 | (EP) . |
| 0704386 | * | 10/1987 | (EP) . |
| 0442179 | * | 8/1991 | (EP) . |
| 562868 | * | 11/1923 | (FR) . |
| 1152875 | * | 2/1958 | (FR) . |
| 1467157 | * | 5/1967 | (FR) . |
| 1098789 | * | 2/1968 | (GB) . |

OTHER PUBLICATIONS

"Die Saam–Box—eine Sammelpackung fur Stehbeutel", Swiss Stars Jun. 1995, pp 1,4.*

* cited by examiner

*Primary Examiner*—Jim Foster

(57) ABSTRACT

A package for a plurality of stand-up pouches in which a rectilinear container holds the pouches with closed top portions of the pouch and is arranged between adjacent base portions of the pouches in the second row to occupy a minimum space. The container can be opened by separating portions along lines of weakening to form display trays which are separate from each other or which are attached to each other in side by side or end to end relationship, all without requiring unpacking or rearranging of the pouches within the container.

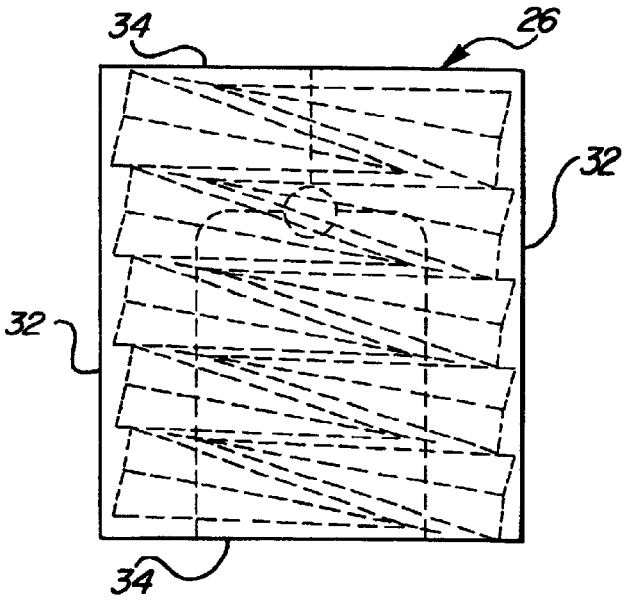

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *